US009874370B2

(12) United States Patent
Uselton

(10) Patent No.: US 9,874,370 B2
(45) Date of Patent: Jan. 23, 2018

(54) SYSTEMS AND METHODS FOR BALANCING AN HVAC SYSTEM

(71) Applicant: Lennox Industries Inc., Richardson, TX (US)

(72) Inventor: Robert B. Uselton, Plano, TX (US)

(73) Assignee: Lennox Industries, Inc., Richardson, TX (US)

( * ) Notice: Subject to any disclaimer, the term of this patent is extended or adjusted under 35 U.S.C. 154(b) by 986 days.

(21) Appl. No.: 14/169,637

(22) Filed: Jan. 31, 2014

(65) Prior Publication Data

US 2015/0219382 A1 Aug. 6, 2015

(51) Int. Cl.

| | |
|---|---|
| ***F25D 17/06*** | (2006.01) |
| ***F24F 13/10*** | (2006.01) |
| ***F24F 11/00*** | (2006.01) |
| ***F24F 11/053*** | (2006.01) |

(52) U.S. Cl.

CPC ..... *F24F 13/10* (2013.01); *F24F 11/0001* (2013.01); *F24F 11/053* (2013.01)

(58) Field of Classification Search

CPC ..... F25D 17/06
USPC ..... 454/258
See application file for complete search history.

(56) References Cited

U.S. PATENT DOCUMENTS 5,623,834 A 4/1997 Bahel et al.
5,873,256 A * 2/1999 Denniston ..... B60H 1/00414 62/244
6,272,868 B1 8/2001 Grabon et al.
6,615,594 B2 9/2003 Jayanth et al.
6,679,072 B2 1/2004 Pham et al.
6,758,051 B2 7/2004 Jayanth et al.
2002/0173929 A1 11/2002 Seigel
2003/0115890 A1 6/2003 Jayanth et al.
2006/0180102 A1* 8/2006 Braun ..... F01P 7/048 123/41.12
2006/0267753 A1* 11/2006 Hussey ..... A61B 5/117 340/505
2007/0298706 A1* 12/2007 Hudon ..... F24F 11/04 454/256

(Continued)

FOREIGN PATENT DOCUMENTS

CA 2344908 A1 1/2002

OTHER PUBLICATIONS

Cheung, Howard, et al., "Modeling of Fault Impacts for a Multi-Split Ductless Heat Pump System," 11th IEA Heat Pump Conference, Montreal (Quebec) Canada, May 12-16, 2014, 11 pages.

(Continued)

*Primary Examiner* — Steven B McAllister
*Assistant Examiner* — Samantha Miller
(74) *Attorney, Agent, or Firm* — Hubbard Johnston, PLLC

(57) ABSTRACT

Systems and methods are disclosed that involve balancing conditioned air delivered to a plurality of zones based on temperature-time profiles for each of the plurality of zones. Wireless temperature sensors may be used to send temperature data to a processing unit to develop the plurality of temperature-time profiles. The temperature-time profiles are analyzed to identify any outliers requiring adjustment of conditioned air to a zone. Adjustments to balance the conditioned air may be made manually or automatically. Other systems and methods are disclosed.

16 Claims, 3 Drawing Sheets

(56) References Cited

U.S. PATENT DOCUMENTS

| | | | | |
|---|---|---|---|---|
| 2008/0299887 | A1* | 12/2008 | Scherer | B64D 13/06 454/71 |
| 2009/0267827 | A1* | 10/2009 | Allison | G01C 15/00 342/357.27 |
| 2009/0277188 | A1* | 11/2009 | Teegen | F25B 39/028 62/50.2 |
| 2010/0173576 | A1* | 7/2010 | Schmid | B64D 13/08 454/75 |
| 2010/0240290 | A1* | 9/2010 | Markwart | B64D 13/00 454/71 |
| 2013/0029578 | A1* | 1/2013 | Wang | G06F 1/20 454/184 |
| 2013/0078161 | A1* | 3/2013 | Smith | A61L 2/04 422/292 |
| 2013/0273826 | A1* | 10/2013 | Aragon | F24F 13/20 454/229 |
| 2013/0317377 | A1* | 11/2013 | Gupta | A61B 5/04525 600/515 |
| 2015/0146759 | A1* | 5/2015 | Johnston | E21B 47/065 374/117 |
| 2015/0217007 | A1* | 8/2015 | Smith | A61L 2/06 422/292 |

OTHER PUBLICATIONS

Vance, W., et al., "Development of Fault Detection and Diagnostic System on Residential Split Air-Conditioning System," National Institute of Standards and Technology, May 9, 2006, 18 pages.

* cited by examiner

SYSTEMS AND METHODS FOR BALANCING AN HVAC SYSTEM

FIELD

This application is directed, in general, to heating, ventilating and air conditioning or cooling (HVAC) systems, and more specifically, to methods and systems for balancing volume delivery.

BACKGROUND

Heating, ventilating, and air conditioning (HVAC) systems can be used to regulate the environment within an enclosed space. Typically, an air blower is used to pull air (i.e., return air) from the enclosed space into the HVAC system through ducts and push the air into the enclosed space through additional ducts after conditioning the air (e.g., heating, cooling or dehumidifying the air). Unless otherwise indicated, as used throughout this document, "or" does not require mutual exclusivity. Various types of HVAC systems may be used to provide conditioned air for enclosed spaces.

Prior to installing an HVAC system, typically a designer will determine preferred air flow rates for each zone, or designated space. In smaller buildings, e.g., small houses, no design may be done at all. At installation, the installer will attempt to set up the HVAC with the design air flows in each zone, or if no design, then based on the installer's estimate of necessary flow proportions. At times, the system has not been designed properly and performs below expectations. At other times, the system may be installed in less than appropriate way. Either way, users may experience suboptimal conditions.

BRIEF DESCRIPTION

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Systems and methods are disclosed herein that involve balancing conditioned air delivered to a plurality of zones in a structure based on temperature-time profiles for each of the plurality of zones. Wireless temperature sensors may be used to send temperature data to a processing unit to develop the plurality of temperature-time profiles. The temperature-time profiles or some aspect thereof are compared to identify zones needing adjustment, or tuning. Adjustments to balance the conditioned air may be made manually or automatically. Typically this involves adjusting dampers.

Figure 1:
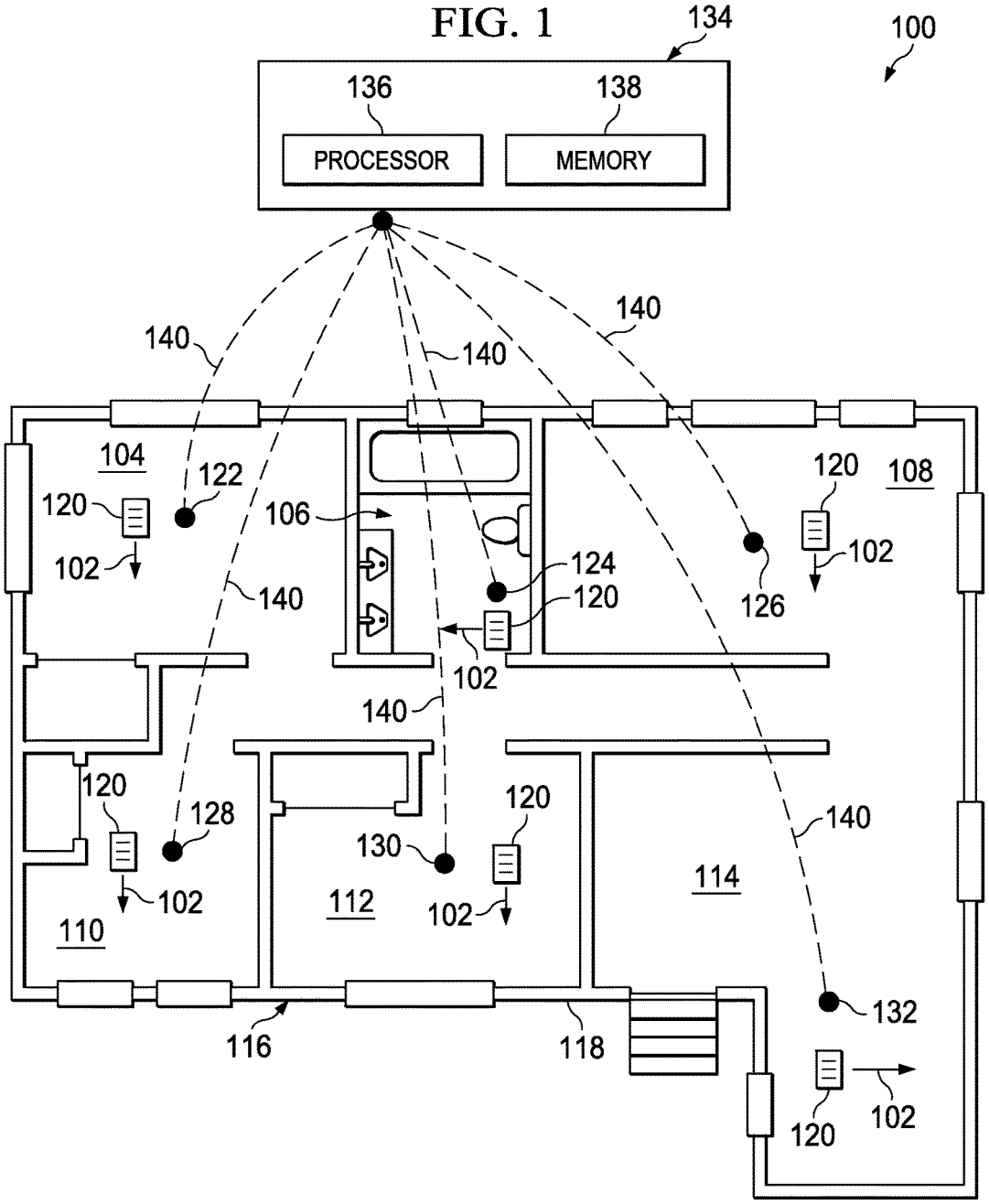
FIG. 1 is a schematic diagram of a portion of an HVAC system according to an illustrative embodiment.
Figure 2:
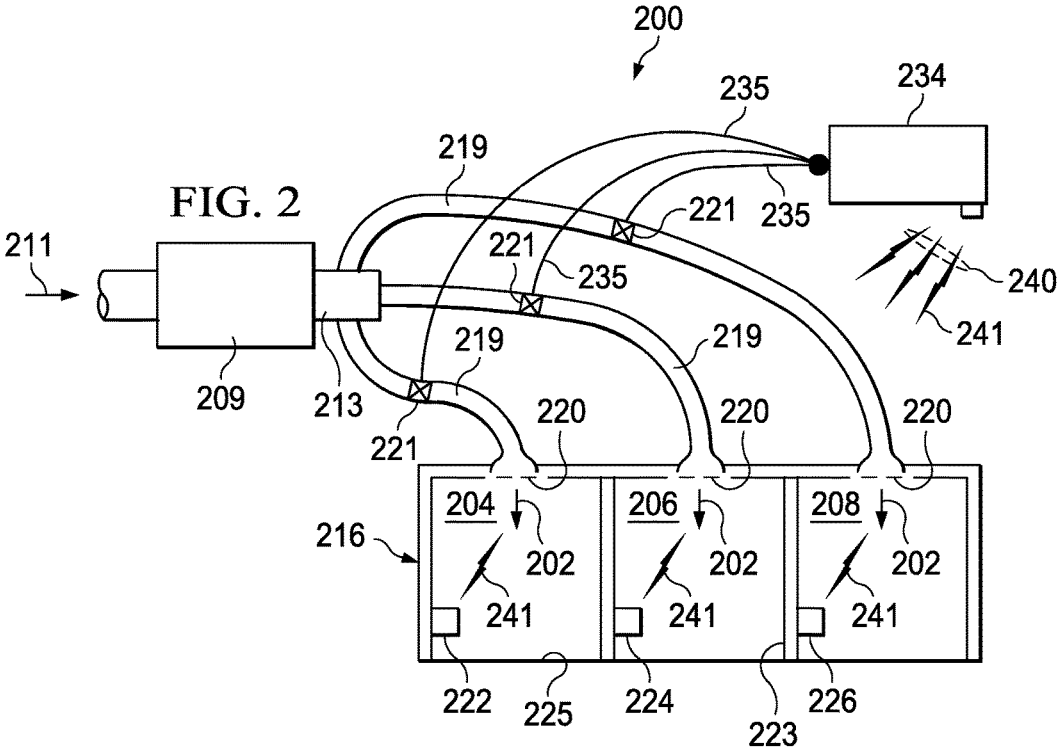
FIG. 2 is a schematic diagram of an HVAC system according to an illustrative embodiment.

Referring now primarily to FIG. 1, a heating, ventilating, and air conditioning (HVAC) system 100 for providing conditioned air 102 to a plurality of zones (e.g., a first zone 104, a second zone 106, a third zone 108, a fourth zone 110, a fifth zone 112, and a sixth zone 114) in a structure 116, e.g., a house 118, commercial building (not shown), automobile (not shown), etc. The conditioned air 102 is produced using any suitable cooling/heating device, e.g., main conditioning unit 209 (FIG. 2). The conditioned air 102 is typically delivered through a plurality of ducts (see, e.g., 219 in FIG. 2) to a plurality of vents 120, which to avoid doubt includes or is the same as registers, or outlets. The plurality of ducts includes one or more balancing dampers (see 221 in FIG. 2), or dampers, to adjust the flow of conditioned air through one or more ducts.

A plurality of temperature sensors, e.g., temperatures sensors 122, 124, 126, 128, 130, and 132, are disposed with the plurality of zones 104, 106, 108, 110, 112, and 114. The plurality of temperature sensors 122, 124, 126, 128, 130, and 132 may be wireless temperature sensors or wired temperature sensors. As one non-limiting, illustrative example, each temperature sensor may be a thermistor. Each of the plurality of temperature sensors 22, 124, 126, 128, 130, and 132 is communicatively coupled to a processing unit 134 by one or more communication links 140. The communication links 140 may be wireless signals (241 in FIG. 2) or conductive wires (not shown).

The processing unit 134 includes one or more processors 136 and one or more memories 138 associated with the one or more processors 136. The processing unit 134 is used to implement the various illustrative blocks, modules, elements, components, methods and algorithms described herein. The one or more processors 136 are configured to execute one or more sequences of instructions, programming or code stored on or in the one or more memories 138, which includes all types of memory devices and includes readable medium used for storage. The processor 136 can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network or any like suitable entity that can perform calculations or other manipulations of data. The memory 138 may include one or more the following: random access memory (RAM), flash memory, read only memory (ROM), programmable read only memory (PROM), erasable PROM, registers, hard disks, removable disks, CD-ROMS, DVDs, or any other suitable storage devices.

Conditioned air is delivered through the vents 120 to cool or heat the zones 104, 106, 108, 110, 112, and 114. The temperature in each zone may be measured by the temperature sensors 122, 124, 126, 128, 130, and 132. By analyzing the temperatures over time, the volume of conditioned air 102 may be adjusted to realize a more balanced system as explained further below.

Referring now primarily to FIG. 2, another illustrative embodiment of a heating, ventilating, and air conditioning system 200 is presented. The system 200 is analogous in most respects to the system 100 of FIG. 1 and accordingly, some parts may be labeled but not further described here. The heating, ventilating, and air conditioning system 200 provides conditioned air 202 to a plurality of zones (e.g., a first zone 204, a second zone 206, and a third zone 208) in a structure 216. The conditioned air 202 is produced using any suitable cooling/heating device, e.g., main conditioning unit 209. The conditioning unit 209 typically includes components for heating or cooling air, such as those found in refrigeration cycles or heat pumps, e.g., compressor, condenser, expander, and evaporator. The conditioning unit 209 receives return air 211, conditions the air as desired, and delivers the conditioned air into a discharge duct 213, which is coupled to one or more ducts 219.

The conditioned air 202 is typically delivered through the one or more ducts 219 to a plurality of registers, or vents 220. The one or more ducts 219 include one or more balancing dampers 221, or dampers, to adjust the flow of conditioned air 202 through one or more ducts 219. As used herein, "dampers" includes any device used to modify or control the airflow rate through a duct. The dampers 221 are associated with the one or more ducts 219 to control airflow through the one or more ducts 219. The one or more dampers 221 are communicatively coupled to a processing unit 234 by communication links 235. The communication links 235 may be conductive wires or wireless signals. In the latter, a processing unit 234 includes one or more transceivers to receive the wireless signals and to provide signals to the dampers 221.

A plurality of temperature sensors, e.g., temperatures sensors 222, 224, and 226, is disposed with the plurality of zones 204, 206, and 208. The temperatures sensors 222, 224, and 226 may be mounted on walls 223 as shown or may be on a floor 225 or elsewhere. In one illustrative embodiment, the plurality of temperature sensors are disposed on the floor 225 during a commissioning process and removed later. The plurality of temperature sensors 222, 224, 226, may be wireless temperature sensors or wired temperature sensors. Each of the plurality of temperature sensors 222, 224, and 226, is communicatively coupled to the processing unit 234 by one or more communication links 240. The communication links 240 may be wireless signals 241 or conductive wires (not shown).

Referring now primarily to FIGS. 1-2, an illustrative embodiment of a method for balancing a volume of conditioned air delivered to a plurality of zones 104, 106, 108, 110, 112, 114, 204, 206, 208 is presented. The method includes deploying the plurality of temperature sensors 122, 124, 126, 128, 130, 132, 222, 224, and 226 in the plurality of zones 104, 106, 108, 110, 112, 114, 204, 206, and 208 in at least a one to one fashion. Thus, at least one temperature sensor is disposed within each zone. Conditioned air is introduced into each of the plurality of zones. Typically, this involves introducing cold air into the zones.

Temperatures are measured for each of the plurality of zones over a first time period and recorded by the processing unit 134, 234. The temperatures are sensed using the plurality of temperature sensors 122, 124, 126, 128, 130, 132, 222, 224, and 226 and sent over the communication link 140, 240 to the processing unit 134, 234 to develop a temperature-time profile for each zone. Each temperature-time profile may be a data set in an array or a curve like or similar to that shown in FIG. 3 or other format. The temperature-time profile is a zone temperature response to the introduction of conditioned air over time.

The processing unit 134, 234 identifies any temperature-time profiles varying from other temperature-time profiles of the plurality of temperature-time profiles by more than a designated margin. In other words, any apparent outlier temperature-time profiles are identified. Once one or more outliers are identified, air flow to one or more of the zones may be tuned or adjusted in response to any identified temperature-time profiles varying from other temperature-time profiles. Thus, air flow to the associated zones may be modified or adjusted to balance, or tune, the air flow. For example, if a zone is cooling quicker than other zones, the amount of conditioned air to that zone would be restricted. As another example, if a zone is cooling slower than other zones, the amount of conditioned air to that zone may be increased. By adjusting the one or more dampers 221, the temperature-time profile of any temperature-time profiles varying from other temperature-time profiles maybe brought closer to conformity with the temperature-time profiles of other zones of the plurality of zones.

These adjustments may be made using the dampers 221. The adjustments may be made to the dampers 221 manually in some embodiments or automatically using actuators on the dampers 221 in other embodiments. In the latter embodiment, the plurality of dampers includes a plurality of actuators that are communicatively coupled to the processing unit 134, 234. The air flow may be tuned by adjusting one or more dampers 221 to bring the temperature-time profile of any temperature-time profiles varying from other temperature-time profiles closer to conformity with the temperature-time profiles of other zones of the plurality of zones by providing a control signal to one or more actuators associated with one or more dampers 221.

Figure 3:
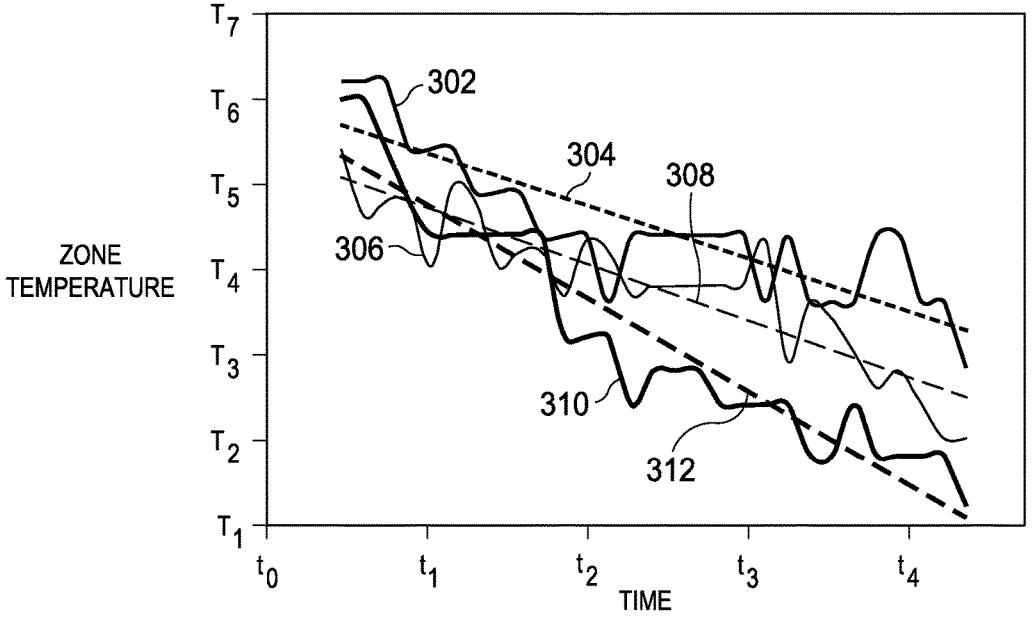
FIG. 3 is a schematic, illustrative graph of temperature-time profiles for three zones.

There are many techniques that may be used to analyze and determine which temperature-time profiles are outliers or need adjusting. Referring now to FIG. 3, one technique will be presented. In FIG. 3, a qualitative graph of three temperature-time profiles is presented for illustrative purposes. The ordinate axis has temperature on it shown going from $T_1$ to $T_7$, which may be for example, without limitation, from 80 to 83 degrees Fahrenheit (26.6 to 28.3 Celsius) or some other range. The abscissa axis has elapsed time; for example, without limitation, the time period may be 30 minutes, but clearly other time periods may be used. Without limitation, other example time periods include 5, 10, 15, 20, 60, 120, 240 minutes, or more or even continuously. The raw data for a first zone is presented by first curve 302. This data may be analyzed using regression analysis, such as least-squares, to develop a representative curve 304, which in this example is linear but could also be exponential in other embodiments. Similarly, the raw data for a second zone is presented by second curve 306. This data also may be analyzed using regression analysis to develop a representative curve 308. Finally, the raw data for a third zone is presented by third curve 310. This data also may be analyzed using regression analysis to develop a representative curve 312.

In comparing the data of FIG. 3, the representations 304, 308, and 312 show that the first two 304, 308 are very similar, but the third 312 shows that the third zone is cooling considerably quicker than the other two. This difference represented by the different slopes may be great enough to warrant correction or further balancing of the system. A preselected amount variance may be established as unacceptable to allow a decision to be made by a processing unit as to whether or not the variance is great enough to require tuning of air flows. If so, the zone requiring tuning may be presented on a display by the processing unit or automated action may occur to adjust a damper for that zone. In some embodiments, the determination may made manually by comparing the data and damper may also be adjusted manually.

In some embodiments, it may desirable to develop a plurality of temperature-time profiles for each zone by recording temperatures over a plurality of time periods. This may, for example, involve recording temperatures at various times during the day to account thermal loads changing, or various times during a longer duration, such as a month or more. The plurality of temperature-time profiles may be averaged to develop an average temperature-time profile for each zone that may be used for further analysis analogous to that previously presented.

It should be noted that while the temperature-time profiles in FIG. 3 are shown for conditioned air the cools the zones, data also may be developed by providing heated air as the conditioned air to the zones. In this latter example, the temperature-time profiles would show the air temperature increasing over time, but otherwise the approaches herein would apply by analogy.

Figure 4:
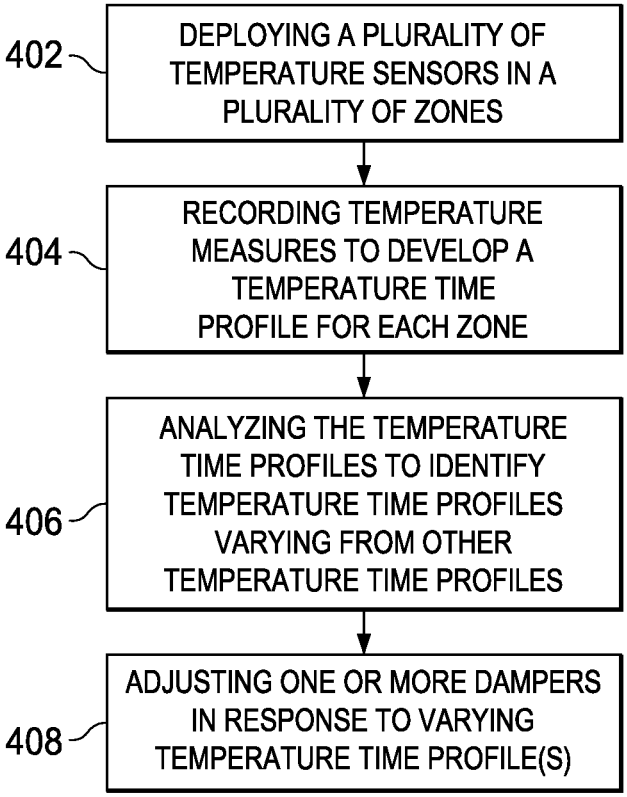
FIG. 4 is an illustrative flow chart for a method of balancing volume of conditioned air delivered to a plurality of zones according to an illustrative embodiment.

Referring now primarily to FIG. 4, an illustrative method of balancing a volume of conditioned air delivered to a plurality of zones is presented. The method includes deploying a plurality of temperature sensors in a plurality of zones at step 402. The temperature measures are recorded while conditioned air is introduced into each of the zones to develop a temperature-time profile for each zone at step 404. The temperature-time profiles are analyzed to identify temperature-time profiles varying from other temperature-time profiles at step 406. The amount of variation required for identification may be preselected. Finally, at step 408, one or more dampers may be adjusted in response to the varying temperature-time profiles to tune the air flow to have temperature-time profiles that are closer to conformity.

Referring again primarily to FIGS. 1 and 2, using the method described herein, the processing unit 134, 234 may be configured to perform operations including storing temperature measurements during a first time interval of operation of the main conditioning unit to develop a temperature-time profile for each zone of the plurality of zones to produce a plurality of temperature-time profiles. The temperature-time profiles may be analyzed by the processing unit 134, 234 to identify one or more outlier temperature-time profiles. The processing unit 134, 234 may then develop tuning instructions in response to any outlier temperature profiles.

It should be understood that the methods and systems herein may be used on an ongoing basis each cycle, some interval of operational cycles, at certain time intervals, at commissioning of the system, or to trouble shoot. The methods and systems may be used on commercial buildings, homes, automobiles, or other situations.

In one illustrative embodiment, a method of commissioning a heating, ventilating, and air conditioning system includes supplying conditioned air to a plurality of zones. The method further includes recording temperatures over time in each of the plurality of zones to develop a plurality of temperature-time profiles and comparing the plurality of temperature-time profiles to identify any outlier temperature-time profiles. The method further includes adjusting the supply of conditioned air to one or more of the plurality of zones in response to the step of comparing the plurality of temperature-time profiles to identify any outlier temperature-time profiles. In one illustrative embodiment, this method is performed with wireless temperature sensors installed in each zone to record the temperatures over time. In another illustrative embodiment, this method is performed with wireless temperature sensors temporarily disposed on a floor in each zone to record the temperatures over time.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A method of balancing a volume of conditioned air delivered to a plurality of zones having at least three zones, the method comprising:

deploying a plurality of temperature sensors in the plurality of zones in at least a one to one fashion;

introducing conditioned air to each of the plurality of zones;

recording temperature measures for each of the plurality of zones over a first time period using the plurality of temperature sensors to develop a temperature-time profile for each zone;

identifying temperature-time profiles varying from other temperature-time profiles by more than a preselected amount;

tuning air flow to one or more of the zones in response to any identified temperature-time profiles varying from other temperature-time profiles by more than the preselected amount;

recording temperature measures for each of the plurality of zones over a plurality of time periods to develop a plurality of temperature-time profiles for each zone;

developing an average temperature profile for each zone from the plurality of temperature-time profiles;

identifying average temperature-time profiles varying from other average temperature-time profiles by more than a designated margin; and tuning air flow to one or more of the zones in response to any identified temperature-time profiles varying from other temperature-time profiles by more than a designated margin.

2. The method of claim 1, wherein the step of tuning air flow comprises adjusting one or more dampers to bring the temperature-time profile of any temperature-time profiles varying from other temperature-time profiles closer to conformity with the temperature-time profiles of other zones of the plurality of zones.

3. The method of claim 1, wherein the step of tuning air flow comprises adjusting one or more dampers to bring the temperature-time profile of any temperature-time profiles varying from other temperature-time profiles closer to conformity with the temperature-time profiles of other zones of the plurality of zones; and wherein the step of adjusting one or more dampers comprises providing a control signal to one or more actuators associated with one or more dampers.

4. The method of claim 1, wherein the step of identifying temperature-time profiles varying from other temperature-time profiles comprises comparing average slope of a temperature-time curve for each zone developed through regression analysis against a slope of each temperature-time curve for each zone.

5. The method of claim 1, wherein the plurality of temperature sensors comprise wireless temperature sensors.

6. The method of claim 1, wherein the plurality of temperature sensors comprise temporary wired temperature sensors.

7. A heating, ventilating, and air conditioning system for providing conditioned air to a plurality of zones in a structure, the system comprising:

a main conditioning unit having a compressor, condenser, expander, and evaporator for producing the conditioned air;

one or more ducts for delivering the conditioned air to the plurality of zones;

one or more dampers associated with the one or more ducts for controlling airflow through the one or more ducts;

a plurality of temperature sensors disposed within the plurality of zones;

a processing unit comprising at least one processor and at least one memory, the processing unit communicatively coupled to the plurality of temperature sensors for receiving data therefrom; and wherein the processing unit is configured to perform operations comprising:

storing temperature measurements during a first time interval of operation of the main conditioning unit to develop a temperature-time profile for each zone of the plurality of zones to produce a plurality of temperature-time profiles, analyzing the plurality of temperature-time profiles to identify one or more outlier temperature-time profiles, and developing tuning instructions in response to any outlier temperature-time profiles.

8. The system of claim 7, wherein the one or more dampers comprise a plurality of actuators communicatively coupled to the processing unit, and wherein the processing unit is further configured to perform operations comprising: using the tuning instructions to develop a control signal sent to one or more of the plurality of actuators to adjust the one or more of the dampers to adjust a volume of conditioned air delivered to one or more zones of the plurality of zones.

9. The system of claim 8, wherein the processing unit is communicatively coupled to the plurality of actuators by conducting wires.

10. The system of claim 8, wherein the processing unit is communicatively coupled to the plurality of actuators by wireless signals.

11. The system of claim 7, wherein the plurality of temperature sensors comprises wireless temperature sensors and the processing unit is communicatively coupled to the plurality of temperature sensors by wireless signals.

12. The system of claim 7, wherein the plurality of temperature sensors comprises wired temperature sensors and the processing unit is communicatively coupled to the plurality of temperature sensors by a plurality of conducting wires.

13. The system of claim 7, wherein the step of analyzing the temperature-time profiles to identify one or more outlier temperature-time profiles comprises performing regression analysis on each temperature-time profile to produce a representative curve and comparing representative curves for each of the plurality of temperature-time profiles.

14. The system of claim 13, wherein the regression analysis comprises least-squares analysis.

15. A method of commissioning a heating, ventilating, and air conditioning system, the method comprising:

supplying conditioned air to a plurality of zones;

recording temperatures over time in each of the plurality of zones to develop a plurality of temperature-time profiles;

comparing the plurality of temperature-time profiles to identify any outlier temperature-time profiles;

adjusting the supply of conditioned air to one or more of the plurality of zones in response to the step of comparing the plurality of temperature-time profiles to identify any outlier temperature-time profiles;

wherein the step of supplying conditioned air to a plurality of zones comprises developing conditioned air in a main conditioning unit and using a plurality of ducts to deliver the conditioned air through a plurality of registers to the plurality of zones; and wherein the step of recording temperatures over time in each of the plurality of zones to develop a plurality of temperature-time profiles comprises deploying wireless temperature sensors in each of the plurality of zones, causing the wireless temperature sensors to send data signals to a processing unit that records signals over time.

16. The method of claim 15, wherein the step of adjusting the supply of conditioned air comprises sending a control signal to one or more dampers.

* * * * *